US011410534B2

(12) United States Patent
Arellano Valderrama

(10) Patent No.: US 11,410,534 B2
(45) Date of Patent: Aug. 9, 2022

(54) FIRE PROTECTION SYSTEM

(71) Applicant: Carrier Corporation, Palm Beach Gardens, FL (US)

(72) Inventor: Julio Cesar Arellano Valderrama, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/124,076

(22) Filed: Dec. 16, 2020

(65) Prior Publication Data

US 2021/0183231 A1 Jun. 17, 2021

(30) Foreign Application Priority Data

Dec. 17, 2019 (EP) ..... 19383127

(51) Int. Cl.

| | |
|---|---|
| ***G08B 1/08*** | (2006.01) |
| ***G08B 25/10*** | (2006.01) |
| ***G08B 17/06*** | (2006.01) |
| ***G08B 17/113*** | (2006.01) |
| ***G08B 25/00*** | (2006.01) |

(52) U.S. Cl.
CPC ..... *G08B 25/10* (2013.01); *G08B 17/06* (2013.01); *G08B 17/113* (2013.01); *G08B 25/003* (2013.01)

(58) Field of Classification Search
CPC ..... G08B 25/10; G08B 17/06; G08B 17/113; G08B 25/003; G08B 25/04; G08B 29/145; G08B 29/22; G08B 17/00
USPC ..... 340/539.1
See application file for complete search history.

(56) References Cited

U.S. PATENT DOCUMENTS

| | | | | |
|---|---|---|---|---|
| 6,078,269 | A | 6/2000 | Markwell et al. | |
| 6,426,697 | B1 | 7/2002 | Capowski | |
| 6,737,967 | B2 | 5/2004 | Farley | |
| 7,336,168 | B2 * | 2/2008 | Kates | G08B 21/0236 340/506 |
| 7,417,540 | B2 | 8/2008 | Johnston et al. | |
| 7,495,544 | B2 | 2/2009 | Stilp | |
| 7,504,937 | B2 | 3/2009 | McKenna et al. | |
| 7,649,450 | B2 | 1/2010 | Campion, Jr. et al. | |
| 8,077,026 | B2 | 12/2011 | Jobe et al. | |
| 8,508,359 | B2 | 8/2013 | Piccolo | |
| 8,773,254 | B2 | 7/2014 | Piccolo | |
| 8,797,141 | B2 | 8/2014 | Best et al. | |
| 9,076,316 | B2 | 7/2015 | Piccolo, III et al. | |
| 9,123,221 | B2 | 9/2015 | Puskarich | |

(Continued)

FOREIGN PATENT DOCUMENTS

| | | | |
|---|---|---|---|
| CN | 109448294 | A | 3/2019 |
| EP | 1468409 | A1 | 10/2004 |

(Continued)

OTHER PUBLICATIONS

European Search Report for Application No. 19383127.8; dated Nov. 5, 2020; 16 Pages.

*Primary Examiner* — Tai T Nguyen
(74) *Attorney, Agent, or Firm* — Cantor Colburn LLP

(57) ABSTRACT

A component 14*a* for a fire protection system 100 includes communications circuitry configured to communicate with another component 14*b*-14*d* of the fire protection system 100. The communications circuitry may allow a portable tool 20 to communicate with the other component 14*b*-14*d* via the component 14*a*.

6 Claims, 3 Drawing Sheets

(56) References Cited

U.S. PATENT DOCUMENTS

| | | | | |
|---|---|---|---|---|
| 9,189,938 | B2 | 11/2015 | Kolb | |
| 9,552,503 | B2 | 1/2017 | Bruemmer et al. | |
| 9,602,301 | B2 | 3/2017 | Averitt | |
| 9,760,853 | B2 | 9/2017 | Rose | |
| 10,074,265 | B2 | 9/2018 | Moffa | |
| 10,216,164 | B2 | 2/2019 | Brown et al. | |
| 2004/0217857 | A1 | 11/2004 | Lennartz et al. | |
| 2006/0109084 | A1 | 5/2006 | Yarvis | |
| 2007/0194907 | A1 | 8/2007 | Tawil | |
| 2013/0285808 | A1 | 10/2013 | Piccolo, III | |
| 2014/0062693 | A1* | 3/2014 | Watts | G08B 25/08 340/539.11 |
| 2015/0212965 | A1* | 7/2015 | Kaestli | H04L 12/40189 710/306 |
| 2016/0066182 | A1* | 3/2016 | Hodge | H04M 3/4365 455/411 |
| 2018/0312255 | A1 | 11/2018 | Illuminati et al. | |

FOREIGN PATENT DOCUMENTS

| | | | |
|---|---|---|---|
| EP | 1929455 | B1 | 6/2008 |
| EP | 2843636 | A1 | 4/2015 |
| EP | 2936468 | A1 | 10/2015 |
| EP | 2955705 | A1 | 12/2015 |
| EP | 2988282 | A1 | 2/2016 |
| EP | 3291195 | A1 | 3/2018 |
| EP | 3319060 | A1 | 5/2018 |

* cited by examiner

FIRE PROTECTION SYSTEM

FOREIGN PRIORITY

This application claims priority to European Patent Application No. 19383127.8, filed Dec. 17, 2019, and all the benefits accruing therefrom under 35 U.S.C. § 119, the contents of which in its entirety are herein incorporated by reference.

TECHNICAL FIELD

The present disclosure relates to a component for a fire protection system, a fire protection system, and to a method of communication in a fire protection system.

BACKGROUND

Fire protection systems typically comprise multiple components, including fire detectors (such as smoke and heat sensors), manual call points, fire alarms, and fire suppression systems (such as sprinklers, fire barriers, smoke extractors, etc.). These are typically electrically connected in a loop configuration, with the connecting wiring starting and finishing at a fire control panel.

In these systems, each component may receive electrical power via the loop. In addition, the fire control panel may be configured to communicate with each component via the loop. This communication may be configured in a master/slave configuration, whereby the master fire control panel can request information from each slave component of the fire protection system.

A fire protection system may also be configured such that each (slave) component can communicate with a (master) portable tool via a short-range wireless communication protocol (such as, e.g., RFID). The portable tool can be employed by an operator, for example during installation of the fire protection system, in order to locally communicate with each component.

The Applicant believes that there remains scope for improvements to components for fire protection systems.

SUMMARY

The present invention provides a component for a fire protection system, the component comprising first communications circuitry configured to communicate with another component of the fire protection system, and second communications circuitry configured to communicate wirelessly with a portable device of the fire protection system.

The first communications circuitry advantageously provides the component of the fire protection system with the ability to communicate directly with another component of the fire protection system. In other words, the first communications circuitry facilities component-to-component communications in the fire protection system. This in turn improves the flexibility and functionally of the fire protection system.

For example, in a fire protection system that is configured such that a first component can communicate (locally) with the portable device (tool), e.g. via short-range wireless communications (such as via RFID), the provision of the first communications circuitry can allow the portable tool to communicate (remotely) with a second component of the fire protection system via the first component. For example, when locally communicating with a first component of the fire protection system (via short-range wireless communications), the portable tool can communicate with a second component of the fire protection system by instructing the first component to communicate with the second component. The first component can in effect act as a relay between the portable tool and the second component, in order to relay communications between the portable tool and the second component.

This then allows the portable tool to communicate with one or more components of the fire protection system that would otherwise be outside of the range of the portable tool's (short-range) wireless communications. This can in turn provide a number of advantages.

For example, this allows an operator to communicate with a component of the fire protection system that would otherwise be difficult or impossible to reach using the portable tool, for example where the component is installed in a relatively inaccessible location that is outside of the range of the portable tool's (short-range) wireless communications, such as within a high ceiling.

This also allows an operator to communicate with multiple components of the fire protection system without having to physically move to within range of each of those components. This can increase the operator's efficiency, for example during installation or maintenance of the fire protection system, in particular where components of the fire protection system are physically dispersed, such as being installed in different rooms or on different floors of a building.

It will be appreciated, therefore, that the present disclosure provides an improved component for a fire protection system, and an improved fire protection system.

The (first) component may comprise any one of a fire detector, a smoke detector, a heat detector, a manual call point, a fire alarm, a fire suppression component, a sprinkler, a fire barrier, a smoke extractor, and the like.

The (second) other component may comprise any one of a fire detector, a smoke detector, a heat detector, a manual call point, a fire alarm, a fire suppression component, a sprinkler, a fire barrier, a smoke extractor, and the like.

The second component may comprise communications circuitry configured to communicate with the first component and/or other components of the fire protection system.

The first communications circuitry (of the first component) may be configured to transmit one or more commands to the other (second) component. The other (second) component may be configured to receive the one or more commands and to perform one or more actions in accordance with the one or more commands. The first component may be configured to act as a master to the second component, and the second component may be configured to act as a slave to the first component.

The one or more commands may comprise a request for data and/or a configuration instruction. The other (second) component may perform one or more actions in accordance with the one or more commands by transmitting data to the first component and/or by configuring itself in accordance with the one or more commands (in accordance with the configuration instruction).

The first communications circuitry (of the first component) may receive, in response to the one or more commands, data from the other (second) component. The data may comprise data relating to the status and/or configuration of the other (second) component.

The component comprises second communications circuitry configured to communicate wirelessly with a portable device of the fire protection system. The second communications circuitry may be separate (distinct) from the first communications circuitry, the first and second communications circuitry may share some circuitry, or the first and second communications circuitry may be implemented using the same (shared) circuitry.

The (first) component may be configured to communicate with the other (second) component in response to one or more second commands received wirelessly from the portable device. The (first) component may be configured to transmit the one or more commands to the other (second) component in response to the one or more second commands received from the portable device. The portable device may be configured to act as a master to the first and/or second component, and the first and/or second component may be configured to act as a slave to the portable device.

The second communications circuitry (of the first component) may wirelessly transmit the data (received by the first component from the other component) to the portable device. Thus, the portable device may obtain data from the other component via the first component (without involving the fire control panel).

An embodiment provides a fire protection system comprising a fire control panel, a plurality of components connected to the fire control panel, and a portable device configured to communicate wirelessly with one or more or each component of the plurality of components, wherein at least one component of the plurality of components comprises the component described above.

The present invention also provides a fire protection system comprising: a fire control panel; a plurality of components connected to the fire control panel; and a portable device configured to communicate wirelessly with one or more or each component of the plurality of components; wherein the plurality of components comprise a first component and second component; and wherein the first component comprises first communications circuitry configured to communicate with the second component.

The plurality of components may be connected to the fire control panel by wiring, optionally wherein the wiring has a loop configuration. The fire control panel may be configured to communicate with (and control) each component via the wiring.

The first communications circuitry of the first component may be configured to communicate with the other (second) component via wired communication. The first communications circuitry may be configured to communicate with the other (second) component via the wiring.

The fire protection system may be configured such that one or more or each component of the fire protection system can transmit one or more commands to one or more or each other component of the fire protection system in the manner described above.

The fire protection system may be configured such that the plurality of components can communicate with one another using a multi-master communications system. Thus, the fire protection system may be configured such that one or more or each component of the fire protection system can act as a master to one or more or each other component of the fire protection system. The fire protection system may be configured such that one or more or each component of the fire protection system can act as a slave to one or more or each other component of the fire protection system.

The present invention also provides a building comprising the fire protection system described above.

The present invention also provides a method of operating a fire protection system, the method comprising a portable device of the fire protection system wirelessly communicating with a component of the fire protection system, and the component of the fire protection system communicating with another component of the fire protection system.

The (first) component may comprise any one of a fire detector, a smoke detector, a heat detector, a manual call point, a fire alarm, a fire suppression component, a sprinkler, a fire barrier, and a smoke extractor.

The other (second) component may comprise any one of a fire detector, a smoke detector, a heat detector, a manual call point, a fire alarm, a fire suppression component, a sprinkler, a fire barrier, and a smoke extractor.

The component communicating with the other component may comprise: the (first) component transmitting one or more commands to the other (second) component; and the other (second) component operating in accordance with the one or more commands.

The other (second) component operating in accordance with the one or more commands may comprise the other (second) component configuring itself in accordance with the one or more commands and/or transmitting data to the first component.

The data may comprise data relating to the status and/or configuration of the other (second) component.

The method may comprise the portable device wirelessly transmitting one or more second commands to the first component, and the first component operating in accordance with the one or more second commands by communicating with the other (second) component. The first component operating in accordance with the one or more second commands by communicating with the other (second) component may comprise the first component transmitting one or more commands to the other (second) component, as described above.

The method may comprise the first component wirelessly transmitting the data (received by the first component from the other component) to the portable device.

A plurality of components of the fire protection system may be connected to a fire control panel by wiring, as described above. The method may comprise the (first) component communicating with the other (second) component via the wiring.

The method may comprise a plurality of components of the fire protection system communicating with one another using a multi-master communications system.

BRIEF DESCRIPTION OF THE DRAWINGS

Certain preferred embodiments of the present disclosure will now be described in greater detail, by way of example only and with reference to the following figures, in which.

DETAILED DESCRIPTION

Figure 1:
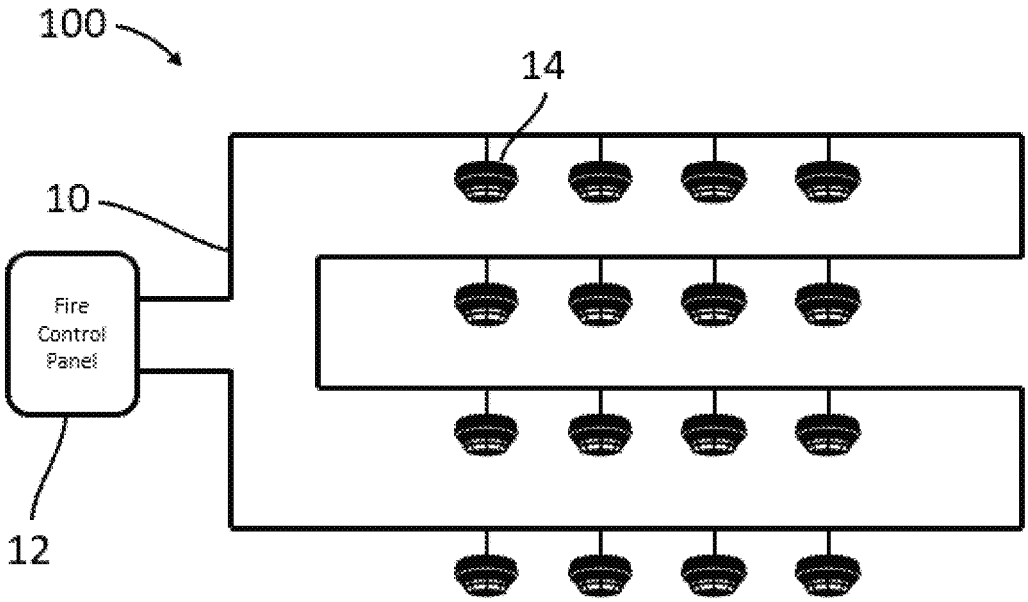
FIG. 1 shows schematically part of a fire protection system comprising a plurality of fire detectors.

FIG. 1 shows schematically part of a fire protection system 100 in accordance with various embodiments. As shown in FIG. 1, the fire protection system 100 may comprise a fire control panel 12 and a plurality of components 14 connected via wiring 10 to the fire control panel 12.

In the embodiment illustrated in FIG. 1, each of the components 14 is a fire detector, which in this example are illustrated as smoke sensors. However, more generally, the plurality of components may include one or more fire detectors (such as one or more smoke and/or heat sensors), one or more manual call points, one or more fire alarms, one or more fire suppression systems (such as one or more sprinklers, fire barriers, smoke extractors, etc.), and the like.

Thus, each component of the fire protection system may comprise any one of a fire detector, a smoke detector, a heat detector, a manual call point, a fire alarm, a fire suppression component, a sprinkler, a fire barrier, a smoke extractor, and the like.

The plurality of components 14 of the fire protection system 100 may be electrically connected via wiring 10, for example in a loop configuration, with the connecting wiring 10 being connected to (for example, starting and finishing at) the fire control panel 12. The fire protection system 100 may be configured such that each component 14 receives electrical power from the fire control panel 12 via the wiring 10.

The fire protection system 100 may be configured such that the fire control panel 12 can communicate with (and control) each component 14, for example via the wiring 10. This communication may be configured in a master/slave configuration, whereby the master fire control panel 12 can request information from and/or control each slave component 14 of the fire protection system 100.

Figure 2:
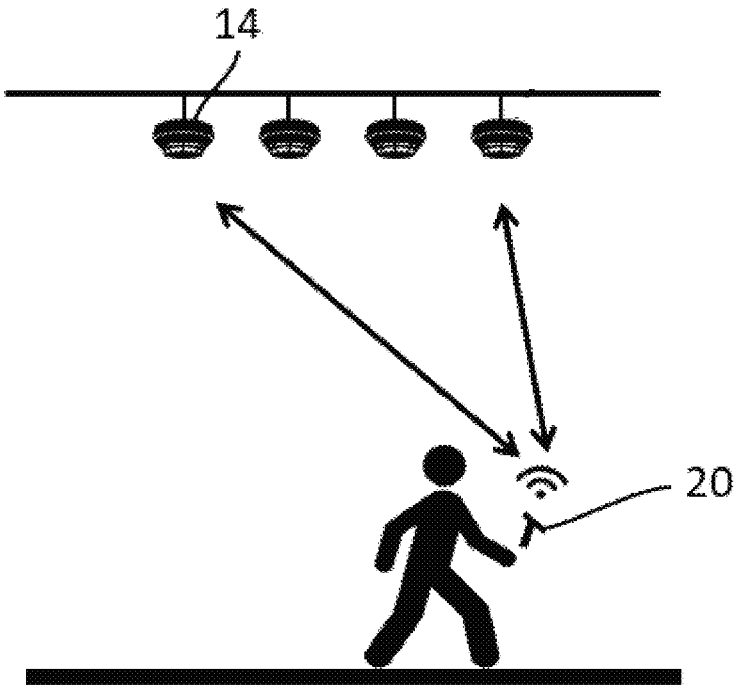
FIG. 2 shows schematically a portable tool communicating with multiple components of the fire protection system.

FIG. 2 shows schematically part of a fire protection system in accordance with various embodiments. As shown in FIG. 2, one or more components 14 of the fire protection system 100 may be installed in a ceiling of a building.

The fire protection system 100 may be configured such that one or more or each component 14 can communicate with a portable device or tool 20 of the fire protection system 100 via a wireless communication protocol. Each component 14 may be configured to communicate wirelessly with the portable tool 20 using any suitable (e.g. short-range) wireless communications protocol, such as for example Wi-Fi, Bluetooth, RFID, and the like.

The portable tool 20 may take any suitable form. For example, the portable tool 20 may be in the form of a "standalone" control device which may optionally be controllable via a mobile communications device 22 such as a mobile phone (cell phone), tablet computer, laptop computer, and the like. It would, however, also be possible for the portable tool 20 to be in the form of a mobile communications device such as a mobile phone (cell phone), tablet computer, laptop computer, and the like.

The communication between the portable tool 20 and the component(s) of the fire protection system may be configured in a master/slave configuration, whereby the master portable tool 20 can request information from and/or control each slave component 14 of the fire protection system 100. That is, the portable tool 20 may be configured to act as a master to each component 14, and each component 14 may be configured to act as a slave to the portable tool 20.

The portable tool 20 may be configured to transmit one or more commands to a component 14. The one or more commands may, for example, request data from the component 14 and/or cause the component to be configured as desired by the operator. The component 14 may receive the command(s) and may be configured to operate in accordance with the command(s), for example by configuring itself accordingly and/or transmitting data to the portable tool 20.

As illustrated in FIG. 2, the portable tool 20 can be employed by an operator, for example during installation of the fire protection system, in order to locally communicate with each component 14. The operator may use the portable tool 20 to obtain component information and/or to configure each component 14.

The component information can comprise, for example, configuration information such as device address and sensitivity profile(s), log information, and the like. The device address, sensitivity profile(s), and the like of each component 14 can be configured by the portable tool 20.

Figure 3:
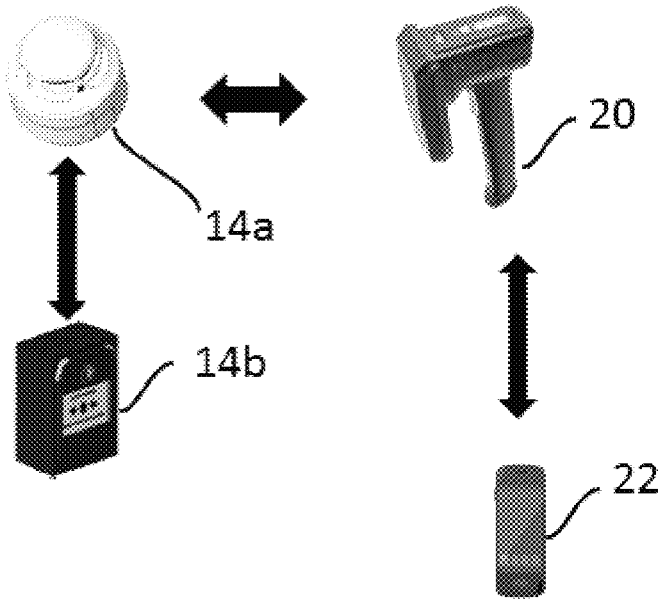
FIG. 3 shows schematically part of a fire protection system comprising a portable tool and multiple components.

FIG. 3 shows schematically part of a fire protection system in accordance with various embodiments. FIG. 3 shows two components 14*a*, 14*b* of the plurality of components 14 of the fire protection system 100, which in the example of FIG. 3 are a fire detector 14*a* and a manual call point (MCP) 14*b*.

FIG. 3 also shows the portable tool 20 wirelessly communicating with one component 14*a* of the plurality of components 14 (as described above). In the example shown in FIG. 3, the portable tool 20 is in the form of a "standalone" control device which may be controlled via a mobile communications device 22 such as a mobile phone (cell phone).

As described above, in accordance with various embodiments, at least one component 14*a* of the fire protection system 100 comprises communications circuitry configured to communicate with another component 14*b* of the fire protection system 100. Thus, for example, in the embodiment illustrated in FIG. 3, a first component 14*a* (being a fire detector) is able to communicate with a second component 14*b* (being a manual call point (MCP)).

As described above, the communications circuitry provides the component 14*a* with the ability to communicate directly with the other component 14*b*. In other words, the communications circuitry facilities component-to-component communications in the fire protection system 100. This in turn improves the flexibility and functionally of the fire protection system 100.

Where, as shown in FIG. 3 (and described above), the fire protection system comprises a portable tool 20, the provision of the communications circuitry can allow the portable tool 20 to communicate (remotely) with the second component 14*b* of the fire protection system via the first component 14*a*. For example, when locally communicating with the first component 14*a* of the fire protection system 100 via (e.g. short-range) wireless communications, the portable tool 20 can communicate with the second component 14*b* of the fire protection system 100 by instructing the first component 14*a* to communicate with the second component 14*b*. The first component 14*a* can in effect act as a relay between the portable tool 20 and the second component 14*b*, in order to relay communications between the portable tool 20 and the second component 14*b*.

This then allows the portable tool 20 to communicate with one or more components 14*b* of the fire protection system 100 that would otherwise be outside of the range of the portable tool's (e.g. short-range) wireless communications. This can in turn provide a number of advantages.

Figure 4:
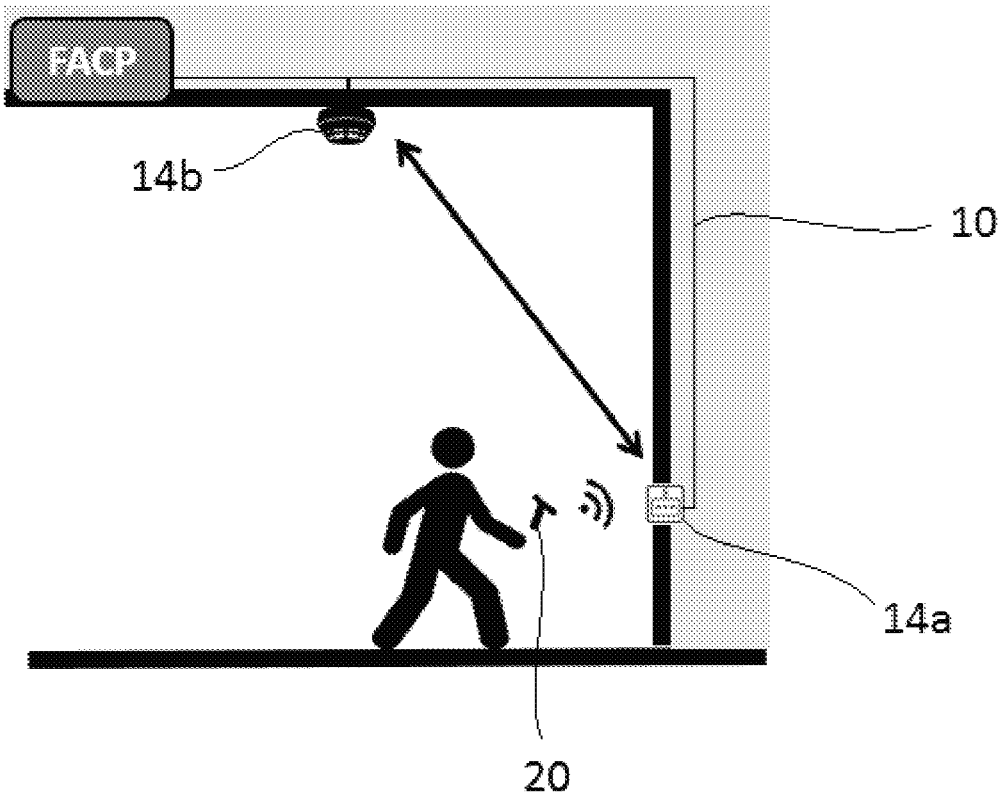
FIG. 4 shows schematically a portable tool communicating with one component of the fire protection system via another component.

For example, as illustrated by FIG. 4, this allows an operator to communicate with a component 14*b* of the fire protection system that would otherwise be difficult or impossible to reach using the portable tool 20, for example where the component 14*b* is installed in a relatively inaccessible location that is outside of the range of the portable tool's 20 (e.g. short-range) wireless communications, such as within a high ceiling. This can be done by the operator communicating with a relatively more accessible component 14*a*, such as a manual call point, and the relatively more accessible component 14*a* relaying communications to the relatively inaccessible component 14*b*, for example via the wiring 10 of the fire protection system.

Figure 5:
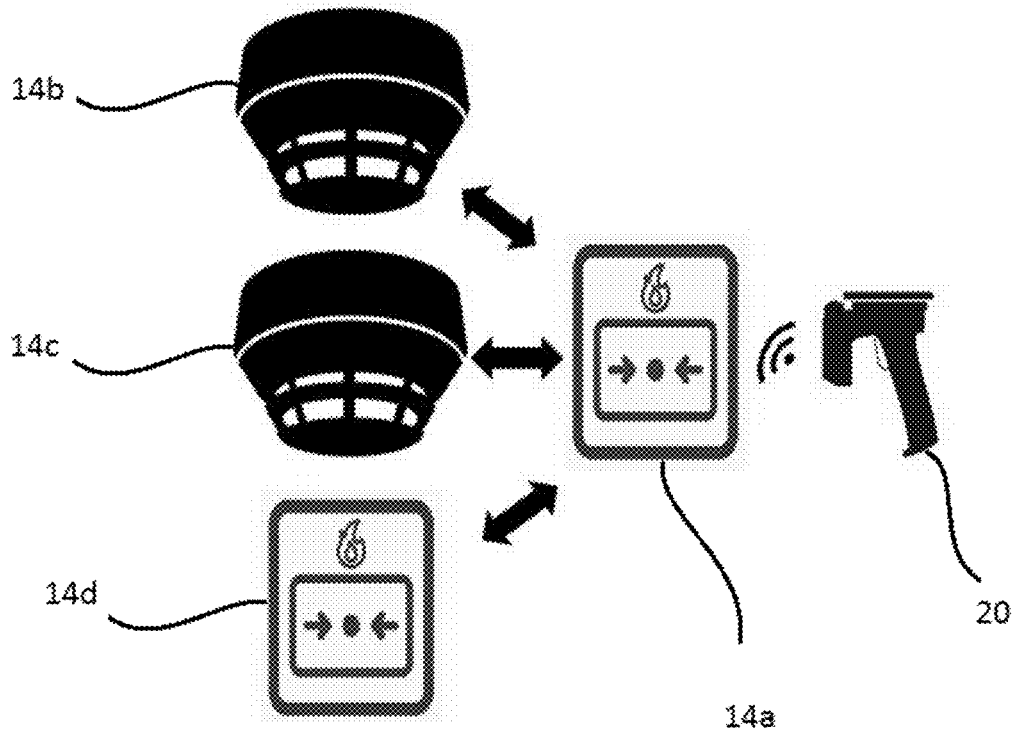
FIG. 5 shows schematically a portable tool communicating with multiple components of the fire protection system via one component of the fire protection system.

As illustrated by FIG. 5, this also allows an operator to communicate with multiple components 14*a*-14*d* of the fire protection system 100 without having to physically move to within range of each of those components 14*a*-14*d*. For example, as shown in FIG. 5, an operator can use the portable tool 20 to communicate with multiple components 14*b*-14*d* via one component 14*a* (such as a relatively accessible manual call point (MCP)) of the fire protection system 100.

This can increase the operator's efficiency, for example during installation or maintenance of the fire protection system, in particular where components of the fire protection system are physically dispersed, such as being installed in different rooms or on different floors of a building.

In various embodiments, it would be possible for the communications circuitry to be configured to communicate with the other component via wireless communication, such as for example Wi-Fi, Bluetooth, RFID, and the like.

However, in various particular embodiments, the communications circuitry is configured to communicate with the other component via a wired connection. For example, the communications circuitry may be configured to communicate with the other component via the connecting wiring 10.

The component-to-component communication may be configured in a master/slave configuration, whereby a master component 14*a* can request information from and/or control each slave component 14*b*-14*d* of the fire protection system 100. That is, a component 14*a* may be configured to act as a master to another component 14*b*-14*d*, and the other component 14*b*-14*d* may be configured to act as a slave to the component 14*a*.

The communications circuitry of the master component 14*a* may be configured to transmit one or more commands to the slave component(s) 14*b*-14*d*. The one or more commands may, for example, request data from the slave component(s) 14*b*-14*d* and/or cause the slave component(s) 14*b*-14*d* to be configured as desired by the operator. The slave component(s) 14*b*-14*d* may receive the command(s) and may be configured to operate in accordance with the command(s), for example by configuring itself accordingly and/or transmitting requested data back to the master component 14*a*.

The data may comprise data relating to the status or configuration of the slave component(s) 14*b*-14*d* such as device address and sensitivity profile(s), log information, and the like. The device address, sensitivity profile(s), and the like of each slave component(s) 14*b*-14*d* can be configured by the portable tool 20 via the master component 14*a*.

The communications circuitry allows the portable tool 20 to be used to communicate with any one of a plurality of components 14*a*-14*d*, via one 14*a* of the components. The communication between the portable tool 20 and the slave component(s) 14*b*-14*d* via the one component 14*a* may be configured in a master/slave configuration, whereby the master tool 20 can request information from and/or control each slave component 14*a*-14*d* of the fire protection system 100. That is, the tool 20 may be configured to act as a master to each component 14*a*-14*d*, and each component 14*a*-14*d* may be configured to act as a slave to the portable tool 20.

The portable tool 20 may be configured to transmit one or more commands to the slave component(s) 14*b*-14*d* via the one component 14*a*. The one or more commands may, for example, request data from the slave component(s) 14*b*-14*d* and/or cause the slave component(s) 14*b*-14*d* to be configured as desired by the operator. The slave component(s) 14*b*-14*d* may receive the command(s) and may be configured to operate in accordance with the command(s), for example by configuring itself accordingly and/or transmitting requested data back to the portable tool 20 via the one component 14*a*.

The data may comprise data relating to the status or configuration of the slave component(s) 14*b*-14*d* such as device address and sensitivity profile(s), log information, and the like. The device address, sensitivity profile(s), and the like of each slave component(s) 14*b*-14*d* can be configured by the portable tool 20 via the master component 14*a*.

Thus, in various embodiments a first component 14*a* may be configured to communicate with a second component 14*b*-14*d* of the fire protection system 100 in response to one or more commands received (via the wireless communications protocol) from the portable tool 20. The portable tool 20 may be configured to receive, in response to the one or more commands, data from one or more of the second component(s) 14*b*-14*d* via the first component 14*a*. In these embodiments, the fire control panel 12 is not involved in the communication between the portable tool 20 and the first component 14*a* and/or the second component 14*b*-14*d*.

One or more or each of the plurality of components 14 of the fire protection system 100 may be configured in the manner of the invention. In various particular embodiments, there are plural components of the plurality of components 14 of the fire protection system 100 that are each configured in the manner of the invention. Thus, one or more or each component of the plurality of components 14 may comprise communications circuitry configured to communicate with another component of the fire protection system 100.

In these embodiments, one or more or each component of the plurality of components 14 may be able to act as a master to one or more or each other component of the plurality of components 14. Correspondingly, the fire protection system may be configured such that one or more or each component of the plurality of components 14 can act as a slave to one or more or each other component of the plurality of components 14. Thus, the fire protection system 100 may be configured as a multi-master system.

Figure 6:
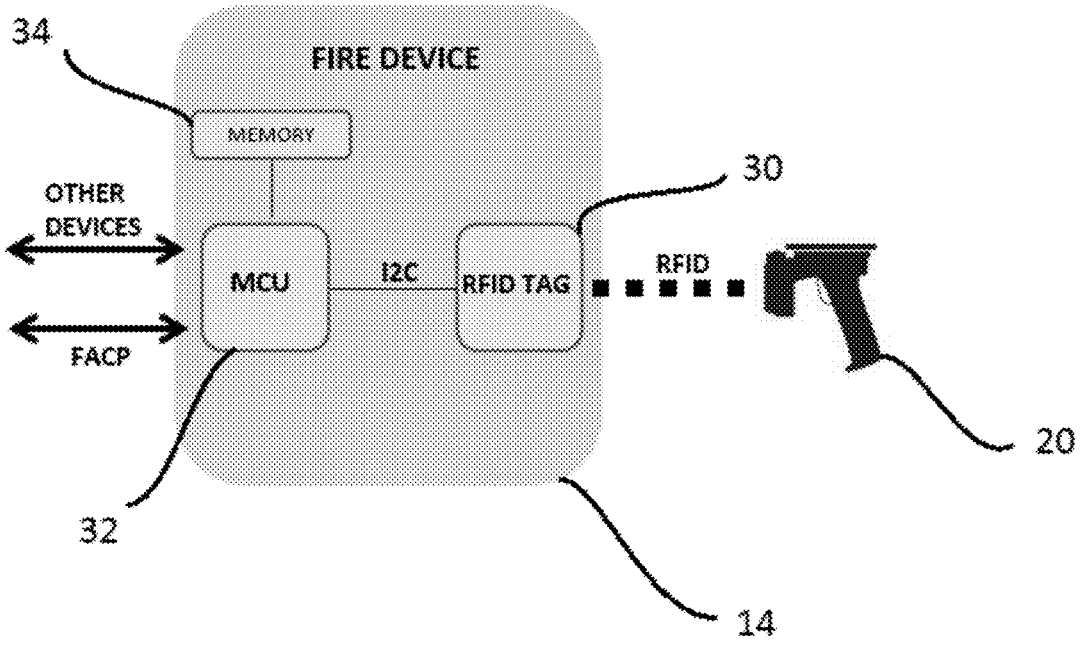
FIG. 6 shows schematically detail of a component of the fire protection system.

FIG. 6 shows schematically a component 14 of the fire protection system configured in accordance with various embodiments. The component 14 may comprise any one of a fire detector, a smoke detector, a heat detector, a manual call point, a fire alarm, a fire suppression component, a sprinkler, a fire barrier, a smoke extractor, and the like.

As shown in FIG. 6, the component 14 may comprise a master control unit (MCU) 32. This may communicate with a memory 34, which may store (e.g.) configuration information such as device address, sensitivity profile, etc., and log information, and the like.

As also shown in FIG. 6, the (master control unit (MCU) 32 of the) component 14 may be configured to communicate with the fire alarm control panel (FACP) 12 of the fire protection system 100, for example via the loop wiring 10, as described above.

The component 14 may be configured to communicate wirelessly with a portable tool 20. In the example illustrated in FIG. 6, this is done via RFID communication, and so the component 14 comprises RFID communications circuitry in the form of an RFID tag 30. It would be possible, however, for the component 14 to communicate with the portable tool 20 using some other wireless communications protocol (as described above). Thus, the component 14 may comprise communications circuitry configured to communicate wirelessly with a portable tool 20 of the fire protection system 100.

The master control unit (MCU) 32 may communicate with the RFID tag 30 via an internal wired connection, using any suitable protocol such as for example I2C communication.

It will be appreciated that allowing the component 14 to communicate wirelessly with the portable tool 20 (which can optionally be controlled by a mobile application) means that an operator can query device information. It also allows parameter configuration such as device address or sensitivity profiles.

As also shown in FIG. 6, in accordance with various embodiments, the (master control unit (MCU) 32 of the) component may be configured to communicate with another component 14*b*-14*d* of the fire protection system 100, as described above. This communication may be via the loop wiring 10 or otherwise (as described above).

This allows the operator to be able to communicate with other devices via the component 14. As described above, this means that the operator need not be near a component in order to be able to interact with it (which may be impractical in installations such as buildings with several floors, or with high ceilings in which the available range may be insufficient).

Various embodiments accordingly allow fire devices to transmit information through the wired loop 10 using a multi-master system which enables communication between any two devices. The protocol can carry information on demand from one device to another. In this way, an operator can use the portable tool 20 via a relatively accessible component 14*a* such as a manual call point (MCP), in order to obtain information from a device 14*b*-14*d* installed in another location.

This can circumvent the range and line of sight limitations of the portable tool 20. This can increase the productivity of an operator, for example when installing and commissioning a large number of devices, as this can be done from the same point without having to move to each location. Other activities such as log querying can also be performed in less time.

What is claimed is:

1. A component for a fire protection system, the component comprising:

first communications circuitry configured to communicate with another component of the fire protection system; and second communication circuitry configured to communicate wirelessly with a portable device of the fire protection system;

wherein the first communications circuitry is configured to transmit one or more commands to the other component;

wherein the first communications circuitry is configured to receive, in response to the one or more commands, data from the other component;

wherein the second communications circuitry is configured to transmit the data to the portable device, wherein the data comprises data relating to at least one of a status and configuration of the other component;

wherein the component is configured to communicate with the other component in response to one or more commands received from the portable device; and wherein the component is configured to communicate with one another using a multi-master communications system.

2. The component of claim 1, wherein:

the component comprises any one of a fire detector, a smoke detector, a heat detector, a manual call point, a fire alarm, a fire suppression component, a sprinkler, a fire barrier, and a smoke extractor; and the other component comprises any one of a fire detector, a smoke detector, a heat detector, a manual call point, a fire alarm, a fire suppression component, a sprinkler, a fire barrier, and a smoke extractor.

3. A fire protection system comprising:

a fire control panel;

a plurality of components connected to the fire control panel; and a portable device configured to communicate wirelessly with one or more of the plurality of components;

wherein at least one component of the plurality of components comprises the component of claim 1.

4. The fire protection system of claim 3, wherein the plurality of components are connected to the fire control panel by wiring, and wherein the first communications circuitry is configured to communicate with the second component via the wiring.

5. A building comprising the fire protection system claim 3.

6. A fire protection system comprising:

a fire control panel;

a plurality of components connected to the fire control panel; and a portable device configured to communicate wirelessly with one or more of the plurality of components;

wherein the plurality of components comprise a first component and second component; and wherein the first component comprises first communications circuitry configured to communicate with the second component;

wherein the first communications circuitry is configured to transmit one or more commands to the second component;

wherein the first communications circuitry is configured to receive, in response to the one or more commands, data from the second component;

wherein the second communications circuitry is configured to transmit the data to the portable device, wherein the data comprises data relating to at least one of a status and configuration of the second component;

wherein the first component is configured to communicate with the second component in response to one or more commands received from the portable device; and wherein the plurality of components are configured to communicate with one another using a multi-master communications system.

* * * * *